US008033052B2

(12) United States Patent
Kraus et al.

(10) Patent No.: US 8,033,052 B2
(45) Date of Patent: Oct. 11, 2011

(54) ANTI-JAMMING DEVICE IN THE FIELD OF MOTOR VEHICLES

(75) Inventors: Thomas Kraus, Kaufering (DE); Jurgen Klingenberg, Neuried (DE); Josef Appel, Gauting (DE)

(73) Assignee: Webasto AG, Stockdorf (DE)

( * ) Notice: Subject to any disclaimer, the term of this patent is extended or adjusted under 35 U.S.C. 154(b) by 445 days.

(21) Appl. No.: 12/063,714

(22) PCT Filed: Aug. 14, 2006

(86) PCT No.: PCT/DE2006/001427

§ 371 (c)(1), (2), (4) Date: Feb. 13, 2008

(87) PCT Pub. No.: WO2007/019836

PCT Pub. Date: Feb. 22, 2007

(65) Prior Publication Data

US 2008/0236044 A1 Oct. 2, 2008

(30) Foreign Application Priority Data

Aug. 16, 2005 (DE) ..... 10 2005 038 617

(51) Int. Cl.
*E05F 15/02* (2006.01)

(52) U.S. Cl. ..... 49/28; 296/56

(58) Field of Classification Search ..... 49/26, 27, 49/28; 296/56

See application file for complete search history.

(56) References Cited

U.S. PATENT DOCUMENTS

| | | | | |
|---|---|---|---|---|
| 1,752,476 | A * | 4/1930 | Boedtcher | 49/27 |
| 1,813,564 | A * | 7/1931 | Conklin | 160/188 |
| 3,050,155 | A * | 8/1962 | Karmel et al. | 49/27 |
| 3,168,165 | A * | 2/1965 | Bagnasco | 187/317 |
| 3,174,743 | A * | 3/1965 | Bowers | 49/28 |
| 3,378,952 | A * | 4/1968 | Bidelman et al. | 49/360 |
| 3,446,264 | A * | 5/1969 | Roemer | 160/188 |
| 6,176,039 | B1 * | 1/2001 | Craig | 49/26 |
| 6,297,605 | B1 * | 10/2001 | Butler et al. | 318/466 |
| 6,588,151 | B1 * | 7/2003 | Goscicki et al. | 49/340 |
| 6,676,186 | B2 * | 1/2004 | Greif | 296/50 |
| 7,219,945 | B1 * | 5/2007 | Zinn et al. | 296/56 |
| 7,320,497 | B2 * | 1/2008 | Zinn et al. | 296/146.4 |
| 7,393,043 | B2 * | 7/2008 | Kargilis et al. | 296/146.4 |
| 2002/0046494 | A1 * | 4/2002 | Miller et al. | 49/26 |
| 2003/0115801 | A1 | 6/2003 | Goscicki | |
| 2004/0088922 | A1 * | 5/2004 | Miller et al. | 49/26 |
| 2009/0000196 | A1 * | 1/2009 | Kollar et al. | 49/28 |
| 2010/0024301 | A1 * | 2/2010 | Wuerstlein et al. | 49/28 |

FOREIGN PATENT DOCUMENTS

| | | |
|---|---|---|
| EP | 0 381 578 | 8/1990 |
| EP | 0 638 701 | 2/1995 |
| EP | 0 783 068 | 7/1997 |
| FR | 2 484 515 | 12/1981 |

* cited by examiner

*Primary Examiner* — Jerry Redman

(74) *Attorney, Agent, or Firm* — Fitch, Even, Tabin & Flannery; John M. Naber

(57) ABSTRACT

The invention relates to an anti-jamming device in the field of motor vehicles, which is used for preventing an object from getting caught. Said anti-jamming device comprises an actuating means (1) which can be coupled to a body part (3) of a vehicle and can be moved relative to said body part (3) by resting the same against the object, and an apparatus for detecting a relative movement between the actuating means (1) and the body part (3).

13 Claims, 3 Drawing Sheets

ANTI-JAMMING DEVICE IN THE FIELD OF MOTOR VEHICLES

CROSS-REFERENCE TO RELATED APPLICATIONS

This application is a 35 U.S.C. §371 National Stage entry of PCT/DE2006/001427, filed Aug. 14, 2006, which claims priority from German Patent Application No. DE 10 2005 038 617.2, filed Aug. 16, 2005, the contents of which are herein incorporated by reference.

BACKGROUND OF THE INVENTION

1. Field of the Invention

The present invention relates to an anti-trap device in the field of motor vehicles for preventing trapping of an object.

2. Description of Related Art

Although applicable to any desired movable components, the present invention and the problem on which it is based are explained in more detail on the basis of a body part in the field of motor vehicles, and in particular with regard to a rear flap of a vehicle.

SUMMARY OF THE INVENTION

In order to improve the operating comfort of motor vehicles and in particular of passenger vehicles, an increasingly large number of manually-driven components have in past years been replaced by motor-driven components, such as for example door windows or sliding roofs, which in the past were opened and closed by means of a hand crank and are now generally provided with a closing and opening mechanism which is driven by an electric motor.

Corresponding development has also commenced for closing or locking mechanisms of front and rear flaps, specifically both for flaps which close off an access to a passenger space or luggage space and also for flaps which, in the form of an engine hood, close off an access to an engine bay. In connection with front or rear flaps, it is possible for electric or hydraulic drives to be used both for pivoting the flap during a closing movement and also for locking the flap. Here, it is for example possible for the rear flap to be coupled by means of an actuating element to an electric or hydraulic motor of a closing mechanism which pivots the rear flap from an open position, in which it opens the opening, into a closed position, in which it closes off the opening. The operation of the motor of the closing and opening mechanism can for example take place from the passenger space or by means of remote control.

With said approach, however, it has proven to be disadvantageous that, during a closing movement for example of the rear flap by means of remote control or from the passenger space, the flap and in particular its free edge is usually not directly visible. In the case of such an automatic closure of the rear flap, it is therefore possible for injury to occur in the case of objects, and in particular of body parts of a person or animal, becoming trapped.

It is known to the applicant, for safety reasons, to provide automatically movable covers and flaps in a vehicle with a stop function in order to stop the component movement in the event of an exceedance of a limit load acting on the cover or on the flap, for example in the event of the rear flap abutting against an obstruction, for example a human hand or a trapped finger.

It is for example known to the applicant to use a tactile sensor strip as a direct anti-trap device, which tactile sensor strip is attached directly to the trapping edges of the rear flap.

German laid-open specification DE 432 29 535 A1 describes using a hollow profile as a tactile sensor strip, which hollow profile provides two opposite conductive regions, a conductive base region and a conductive arched profiled region. The two regions are separated by means of insulating profiled sections. Under a corresponding pressure, for example as a result of a trapped hand, the hollow profile is compressed, and the two conductive regions come into contact and trigger an electrical contact and a switching process which stops the drive mechanism. A measurement of the pressure difference as a result of deformation of the sensor strip on account of contact against the trapped object is also conceivable.

With said approach, however, it has proven to be disadvantageous that a sensor strip attached directly to the trapping edges of the rear flap outputs a signal to a controller in order to stop the drive mechanism only in the event of trapping occurring, wherein it is possible, even in the event of correct detection, for the forces acting on the for example trapped hand until the drive mechanism is stopped to already be high enough to pose a considerable risk of injury.

It is also known to the applicant to provide an indirect anti-trap device which detects trapping on the basis of the motor rotational speed or current profile of the drive mechanism. For example, in the case of an electric motor being used as a drive mechanism, the power consumption is continuously measured and the motor is switched off if the power consumption exceeds a predetermined threshold value when an obstruction is impinged upon.

With said approach, however, it has proven to be disadvantageous that such protective measures are not suitable for a closing mechanism, for example of a rear flap of a motor vehicle, since the forces required for locking a rotary lock with a closing bar and their tolerances are relatively large, so that for example an additional resistance as a result of a trapped finger would not be measurable. As before, there is therefore a considerable risk of injury with said approach too.

It is therefore possible in the case of automatically moved body parts, such as for example in the case of rear flaps which are rotated by means of a hinge or a four-bar mechanism, for very large trapping forces to occur close to the center of rotation, so that a use of such indirect anti-trap devices is not suitable for preventing injuries.

It is therefore the object of the present invention to design an anti-trap device in such a way that, even in the case of automatically moved body parts, a reliable anti-trap function is ensured and the risk of injury is reduced.

SUMMARY OF THE INVENTION

The concept on which the present invention is based is that of the anti-trap device for preventing trapping of an object having an actuating means which can be coupled to a body part of a vehicle and, as a result of contact against the object, is movable relative to the body part; and a detection device for detecting a relative movement between the actuating means and the body part.

The actuating means therefore serves to create an indirect anti-trap device which, on account of the leading relative movement of the actuating means with respect to the associated body part, signals a trapped object already when high trapping forces are not yet acting on the trapped object. As a result, injuries to a for example trapped finger or a trapped hand can be prevented in a simple and cost-effective manner.

According to one preferred refinement, the anti-trap device has a fastening strip which can be fixedly attached to the body part of the vehicle and to which the actuating means is articulatedly connected so as to be pivotable about a rotary axle. As a result, in the event of contact against a trapped object, a relative movement takes place between the actuating means and the fastening strip or the body part to which the fastening strip is fixedly attached. The additional fastening strip ensures simple retrofitting to for example existing body parts, and therefore complex and expensive retrofitting processes are dispensed with. It is however obvious to a person skilled in the art that it is likewise possible for the actuating means to be directly mounted on the body part. In this case, the fastening strip can under some circumstances be dispensed with.

According to a further preferred refinement, the fastening strip has the rotary axle about which the actuating means is rotatably mounted and a guide means, which is spaced apart from the rotary axle, for the mounting and pivoting guidance of the actuating means. The guide means is for example embodied as a guide bolt which can be mounted on the fastening strip and which engages into a slot which is provided in the actuating means and which is aligned in the direction of the pivoting movement. The actuating means is therefore mounted in a stable fashion and so as to be pivotable about the rotary axle as a result of pivoting mounting by means of the rotary axle and as a result of guiding mounting by means of the slot.

According to a further preferred exemplary embodiment, the rotary axle is assigned to that region of the body part on which low trapping forces act, and the guide means is assigned to that region of the body part on which relatively large trapping forces act. This ensures that in particular a relative movement between the actuating means and the fastening strip or the body part is generated and detected in the region in which there is the greatest risk of injury in the event of for example a finger becoming trapped.

The actuating means can preferably be preloaded with respect to the fastening strip, or with respect to the body part in the case of the actuating means being directly mounted on the body part, by means of a spring device. This ensures that, in the event of a relative movement of the actuating means as a result of contact against an object, when the object is removed, the actuating means is returned to the initial position.

According to a further preferred refinement, the actuating means is embodied as a leader strip which is pivotable relative to the body part or the fastening strip about a rotary axle. Said leading leader strip preferably undergoes a relative movement with respect to the body part already before relatively large trapping forces can act on the trapped object.

In each case one leader strip is for example pivotably attached by means of in each case one associated fastening strip or directly in the region of the longitudinal side of a rear flap of a vehicle. In this way, a risk of injury on account of, for example, a trapped body part is reduced at both longitudinal sides of a rear flap during a closing movement of the latter.

According to a further preferred exemplary embodiment, the detection device is embodied as an electric mechanical or electromechanical inductive switch or the like, for example as a microswitch or proximity switch, which can be attached to the body part, to the actuating means and/or to the fastening strip. The detection device can for example be embodied as a switch of which the guide means, advantageously a steel guide bolt, forms a constituent part, for example the mating contact face of a microswitch or a constituent part of a Hall sensor. In this way, a relative movement between the actuating means and the fastening strip or the body part is detected quickly and reliably in a simple and cost-effective manner, so that the drive mechanism for an adjustment of the body part can quickly and reliably be deactivated in order to stop the movement of the body part.

It is alternatively or additionally possible for the detection device to be embodied as a tactile sensor strip as well which can be attached to the face, which comes into contact with the object, of the actuating means. In this way, the drive mechanism can be deactivated in good time in order to stop the movement of the body part in the event of the clamped object coming into contact with the sensor strip.

In addition, the detection device can additionally or alternatively also be embodied as a sensor which can be attached to a mating contact section, which is assigned to the body part. It is essential merely that a relative movement between the actuating means and the fastening strip or the body part can be quickly and reliably detected.

For example, when a relative movement between the actuating means and the body part or the fastening strip is detected, the drive mechanism of the body part can be deactivated in the case of an automatically actuable body part, and a warning signal, for example an audible warning signal, can be generated in the case of a manually actuable body part. The risk of injury is therefore considerably reduced in a simple and cost-effective manner.

The actuating means and/or the fastening strip are preferably produced from plastic. In this way, the anti-trap device according to the invention can be produced in a simple and cost-effective manner and can be mounted on and retrofitted to a body part using corresponding means.

BRIEF DESCRIPTION OF THE DRAWINGS

The invention is explained in more detail below on the basis of exemplary embodiments with reference to the appended figures of the drawing, in which.

In the figures of the drawing, the same reference symbols denote identical or functionally identical components unless specified otherwise.

DETAILED DESCRIPTION OF THE INVENTION

Figure 1:
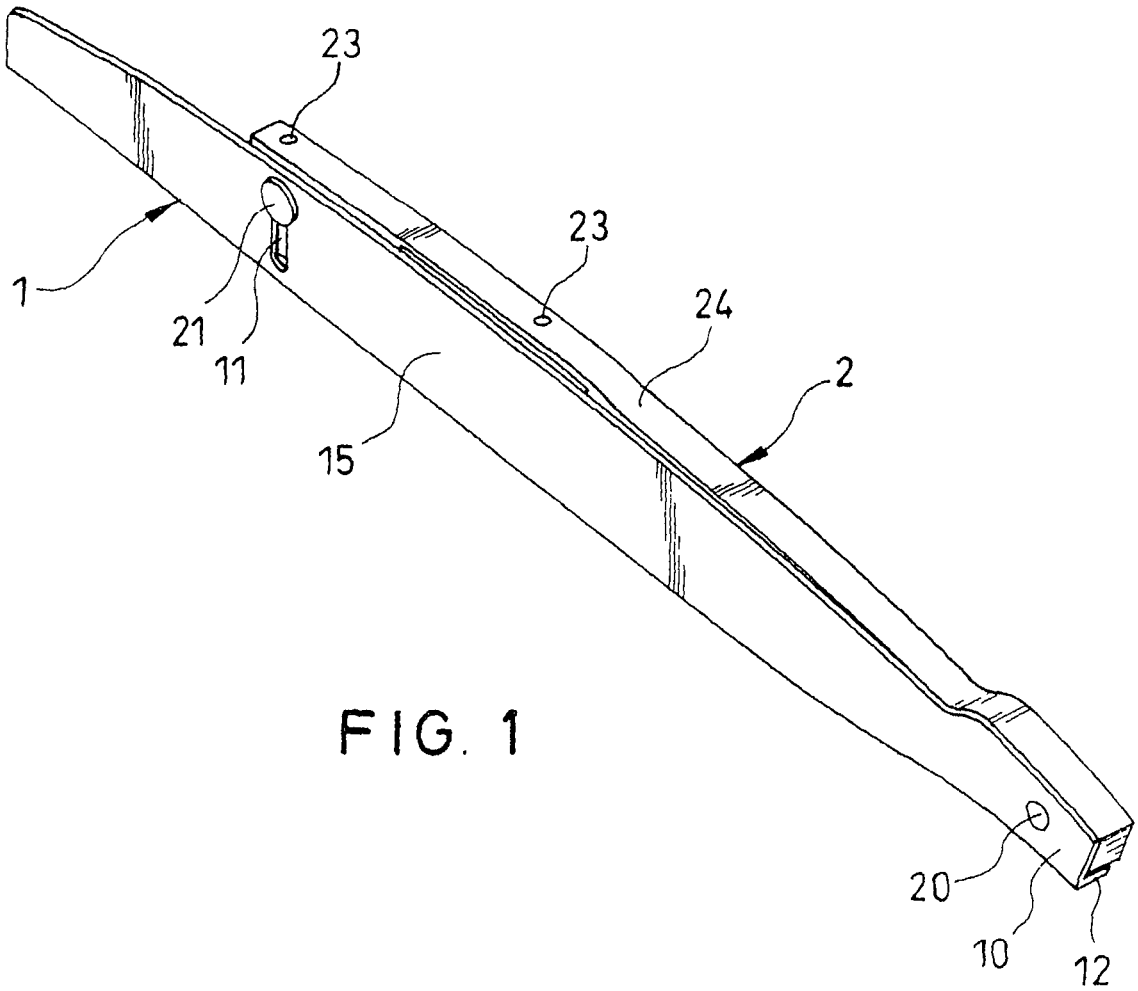
FIG. 1 shows a perspective front view of an anti-trap device according to a preferred exemplary embodiment of the present invention.
Figure 2:
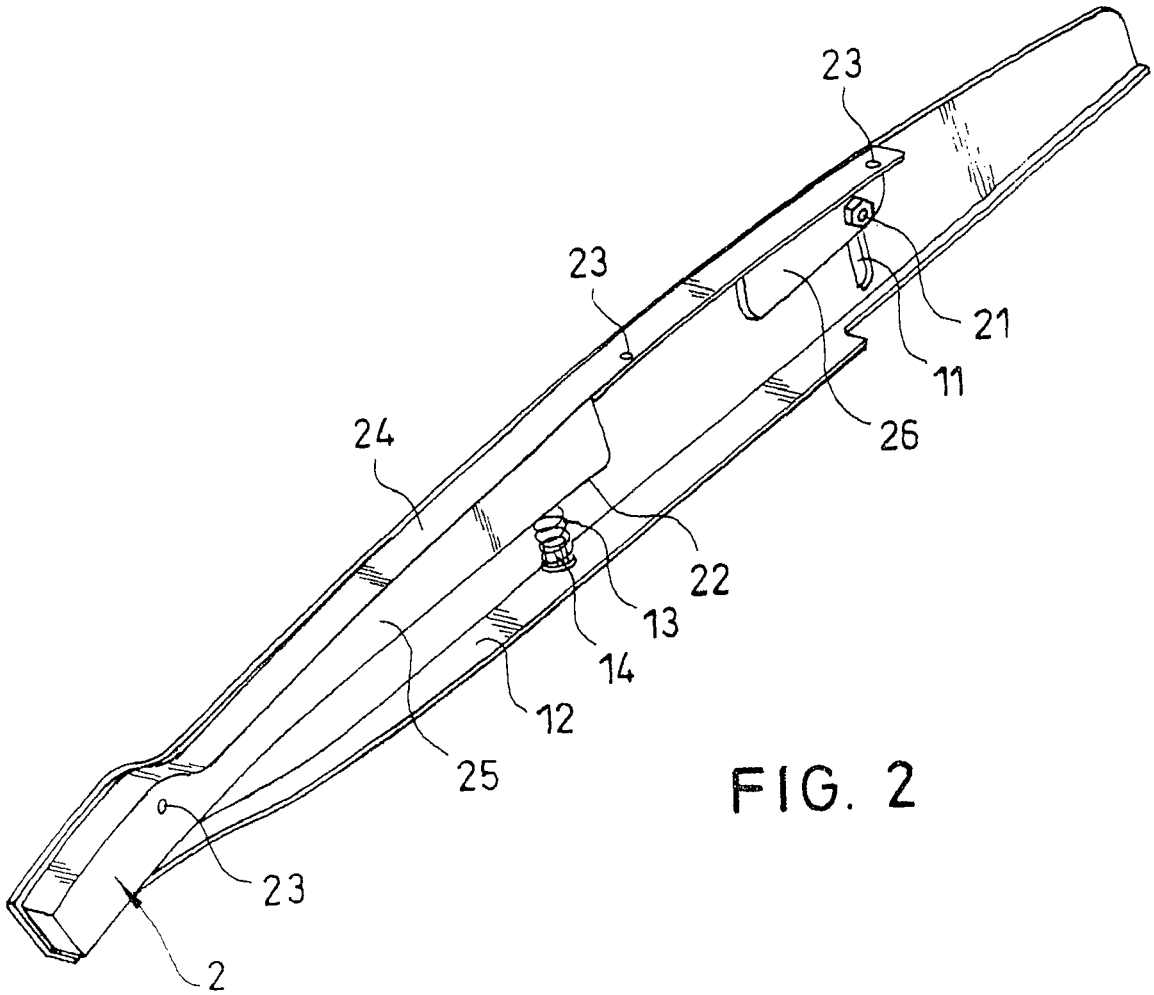
FIG. 2 shows a perspective rear view of the anti-trap device from FIG. 1.

FIGS. 1 and 2 illustrate a perspective front view or rear view of an anti-trap device according to the invention as per one preferred exemplary embodiment of the present invention, not assembled on a body part.

As can be seen from FIGS. 1 and 2, the anti-trap device as per the exemplary embodiment illustrated in the figures has a leading leader strip 1 which extends in the longitudinal direction and which serves as an actuating means. The leader strip 1 is preferably produced from a suitable plastic and is composed for example of a planar, elongate front face 15 and a suitably profiled lower face 12 which is angled with respect to said front face 15 for example by an angle of approximately 90°. The leader strip 1 also has an articulation section 10 on the front face 15 with a through hole for receiving a rotary axle 20, as is explained in more detail further below.

In addition, the leader strip 1 in the front face 15 comprises a slot 11 which is spaced apart from the articulation section 10 and is advantageously arranged in the region of that end of the elongate front face 15 of the leader strip 1 which is situated opposite from the articulation section 10. The slot 11 serves to hold a guide bolt as described in more detail further below.

As illustrated in FIG. 2, a spring holding pin 14 is integrally formed approximately centrally on the upper side of the angled face 12, onto which a spring 13 with a predetermined preload force is plugged in a positionally stable fashion.

The exemplary anti-trap device illustrated also has a fastening strip 2 which is embodied as a profiled carrier arm which preferably extends in the longitudinal direction. The fastening strip 2 as per the present exemplary embodiment is composed, as per FIG. 2, of an upper section 24 which is preferably aligned perpendicular to the front face 15 and approximately parallel to the angled face 12 of the leader strip. Integrally formed on the upper section 24 of the fastening strip 2 are for example a plurality of perpendicularly, downwardly angled sections 25, 26, with the angled section 25 being arranged in the region of the section which comprises the rotary axle 20 and serving to hold the rotary axle 20 and to guide the spring 13, and with the angled section 26 being provided in a region, which is assigned to the slot 11, of the fastening strip 2 and serving as a mount for the guide bolt 21. The guide bolt 21 is for example screwed by means of a screw nut in a through hole in the angled section 26 of the fastening strip 2, as illustrated in FIG. 2. The fastening strip 2 is preferably likewise produced from a suitable plastic.

The fastening strip 2 serves for fastening to an associated body part and for pivotably movably mounting the leader strip 1. For fastening the fastening strip 2 to an associated body part, the fastening strip 2 has, at suitable sections, fastening holes 23 for receiving fastening screws.

Held in the region of the one end of the fastening strip 2 is the rotary axle 20 already mentioned above, on which the leader strip 1 is mounted in a pivotably movable fashion. In the region of the opposite end of the fastening strip 2, the guide bolt 21 which is likewise already mentioned above is attached so as to extend in the transverse direction in such a way that the bolt shank can be inserted through the slot of the leader strip 1 and the bolt head engages behind the slot 11.

As a result of the mounting of the leader strip 1 on the rotary axle 20 of the fastening strip 2 and on the guide bolt 21 of the fastening strip 2, the leader strip 1 is pivotably guided by means of the bolt 21 which is guided in the slot 11, and the leader strip 1 is therefore attached to the fastening strip 2 in a stable fashion and so as to be pivotable about the rotary axle 20.

For a preload of the leader strip 1 with respect to the fastening strip 2, the spring 13 which is plugged onto the spring holding pin 14 is supported on an associated spring contact section 22 of the fastening strip 2. The spring contact section 22 can for example be formed by an additionally angled and horizontally-running section of the fastening strip 2 which is provided above the spring for contact against the latter. Alternatively, the spring contact section 22 can be formed by the lower face of the upper section 24.

Figure 3:
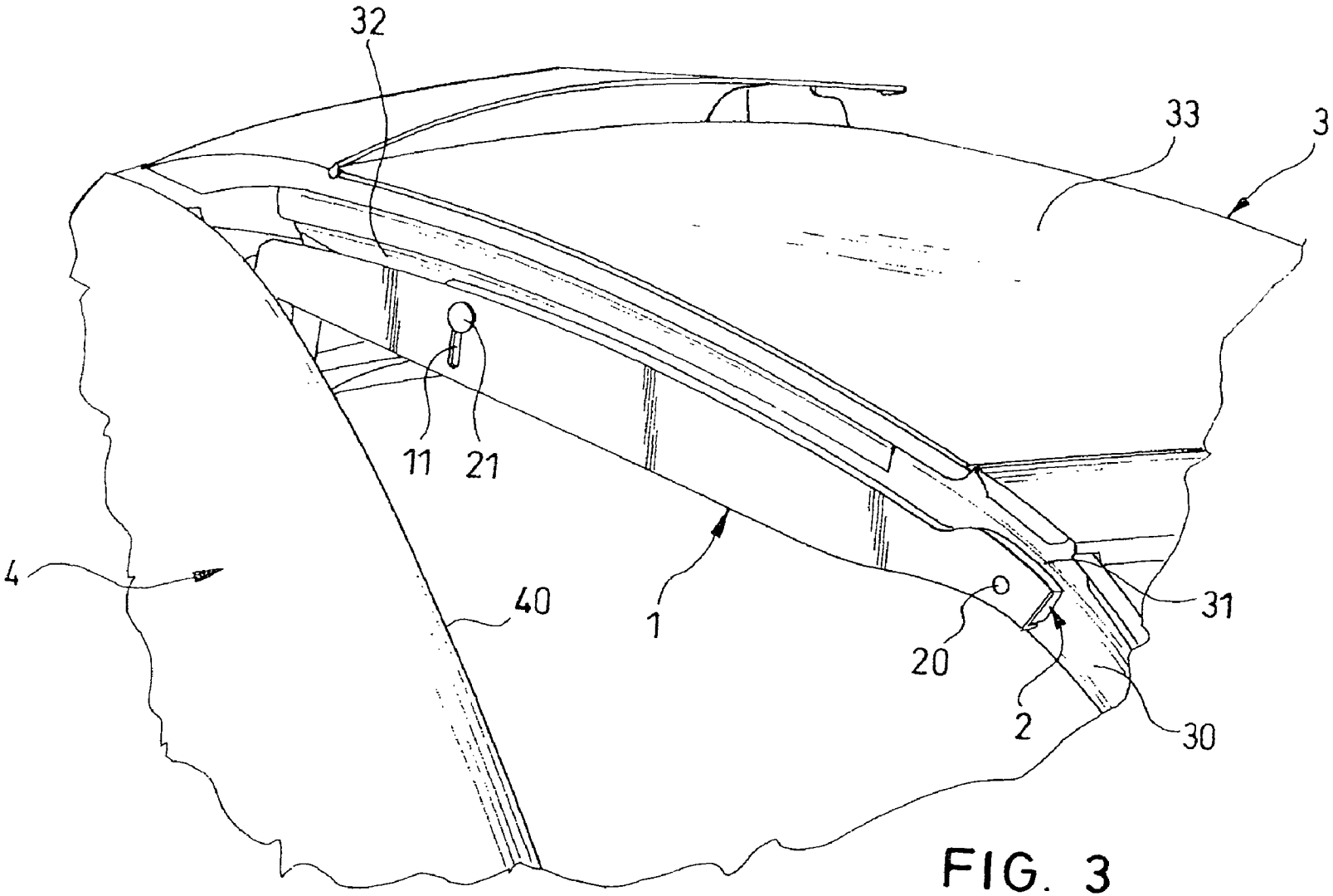
FIG. 3 shows a perspective view of the anti-trap device from FIGS. 1 and 2 mounted on a longitudinal side of a rear flap.

FIG. 3 illustrates a perspective view of the anti-trap device, explained with reference to FIGS. 1 and 2, as per one preferred exemplary embodiment of the present invention, mounted on a rear flap 3 of a vehicle.

As can be seen in FIG. 3, the fastening strip 2 is preferably fixedly mounted on a longitudinal side 30 of the rear flap 3, by means of the fastening holes 23 and suitable screw means, in such a way that the fastening strip 2 and the leader strip 1 extend in the longitudinal direction of the longitudinal side 30 of the rear flap 3.

Although FIG. 3 illustrates an attachment of an anti-trap device only to the left-hand longitudinal side of the rear flap 3, it is self-evident to a person skilled in the art that anti-trap devices of said type are advantageously attached to both longitudinal sides of the rear flap 3 in order to prevent injuries at both sides.

The exemplary anti-trap device is preferably mounted on the associated body part or on the associated longitudinal side 30 of the rear flap 3 in such a way that the rotary axle 20 is assigned to the region of relatively low trapping forces 31, for example to the region slightly below the rear window 33, and that end of the fastening strip 2 or leader strip 1 which is situated opposite from the rotary axle 20 is assigned to the region of relatively high trapping forces 32, for example the region at the level of the upper edge of the rear window 33. In this way, it is ensured that, in particular in the region of relatively high trapping forces 32, a relative movement of the leader strip 1 with respect to the fastening strip 2 or the longitudinal side 30 of the rear flap 3 takes place in the event of an object becoming trapped.

The anti-trap device also preferably has at least one detection device for detecting a relative movement between the leader strip 1 and the fastening strip 2, with a signal being output in the event of a detected relative movement. For example, in the case of an automatically actuable rear flap 3, when a relative movement is detected, a signal is generated which deactivates the drive mechanism for closing the rear flap 3 or initiates an opening movement of the rear flap 3 in the opposite direction. In this way, the closing movement is not continued, and trapping of an object, in particular of a body part, is prevented, so that injuries can be prevented.

In the case of a manually actuable rear flap, it is for example possible for an audible warning signal to be generated, so that the user who is closing the rear flap 3 is advised by the warning signal of the risk of an object becoming trapped. Injuries can advantageously be avoided in this case too.

The detection device for detecting a relative movement between the leader strip 1 and the fastening strip 2, or between the leader strip 1 and the body part in the case of the leader strip 1 being directly mounted on the body part 3, can be embodied as any type of sensor or switch which is suitable for detecting a relative movement of two components with respect to one another. As an electric detection device, use is preferably made of a proximity switch such as for example a Hall sensor or the like, or as an electromechanical detection device, use is preferably made of a microswitch, which detection devices are for example attached to the fastening strip 2 or to the rear flap 3 in such a way that they can detect a relative movement of the leader strip 1.

It is for example possible for the guide bolt 21 to be formed from steel or the like and to form a constituent part of the switch or sensor, for example the mating contact face of a microswitch, or a constituent part of a Hall sensor. Alternatively, it is also possible for a switching cam or the like, which is correspondingly assigned to the switch, to be provided on the leader strip 1.

The detection device can also be embodied as a tactile sensor strip which is attached to the underside of the leader strip 1. In this way, in the event of the tactile sensor strip coming into contact against the object, a signal is generated, while the leader strip 1 performs a leading pivoting movement relative to the fastening strip 2 or the body part 3 without it being possible for excessively high trapping forces to act on the trapped object.

It is also possible for a sensor to alternatively or additionally be attached to a mating contact section 40 of the vehicle body 4, which mating contact section 40 detects a relative movement of the leader strip 1 with respect to the fastening strip 2 or the body part 3 and generates a corresponding signal for deactivating the drive mechanism or an audible signal.

Although the present invention has been described above on the basis of preferred exemplary embodiments, the present invention is not restricted to these but can be modified in numerous ways.

It is obvious to a person skilled in the art that any type of detection devices can be used for detecting a relative movement between the fastening strip and the leader strip, for example electrical, electromechanical, mechanical, inductive switches or the like as long as the relative movement can be detected reliably and with a low delay time. Here, the switches or sensors can be attached at suitable sections to the leader strip, to the fastening strip, to the movable body part or to the vehicle body.

Although the present invention has been described on the basis of a rear flap of a vehicle, the anti-trap device according to the invention can be applied to any body parts which are movable relative to a body section of the vehicle. Examples of these are the motor vehicle doors, the engine hood, a sliding roof or a roof which can be folded open and closed, for example a hard top or soft top, of a cabriolet.

It is also obvious to a person skilled in the art that it is likewise possible for the actuating means to be directly mounted on the body part. In this case, the fastening strip can under some circumstances be dispensed with.

The invention claimed is:

1. An anti-trap device on a vehicle for preventing trapping of an object between two parts of the vehicle, comprising:

an actuating means which can be coupled to a body part of the vehicle and, as a result of contact against the object, is movable relative to the body part;

a detection device for detecting a relative movement between the actuating means and the body part;

a rotary axle mounted on the body part, and wherein the actuating means is pivotally mounted to the rotary axle; and a fastening strip which is fixedly attached to the body part of the vehicle and to which the actuating means is articulatedly connected by the rotary axle, the fastening strip further comprising a guide means, which is spaced apart from the rotary axle, for mounting and pivoting guidance of the actuating means;

wherein the guide means is embodied as a guide bolt which is mounted on the fastening strip and which engages into a slot which is provided in the actuating means and which is aligned in the direction of the pivoting movement.

2. The anti-trap device of claim 1, wherein the rotary axle is assigned to that region of the body part on which lower trapping forces act relative to regions of the body part on which higher trapping forces act, and in that the guide means is only assigned to that region of the body part on which the higher trapping forces act.

3. The anti-trap device of claim 1 wherein the actuating means can be preloaded with respect to the fastening strip by means of a spring device.

4. The anti-trap device of claim 1, wherein the actuating means is embodied as a leader strip which is pivotable relative to the body part about the rotary axle.

5. The anti-trap device of claim 1 being disposed in the region of each longitudinal side of a rear flap of the vehicle.

6. The anti-trap device of claim 1, wherein the detection device is at least one of:

an electric switch,
a proximity switch,
a mechanical switch,
an electromechanical switch,
a microswitch,
an inductive switch, and
a sensor.

7. The anti-trap device of claim 1 wherein the detection device is at least one of:

a switch of which the guide means forms a constituent part, a microswitch having a mating contact surface formed by the guide means, and a Hall sensor partially formed by the guide means.

8. The anti-trap device of claim 1, wherein the detection device is embodied as a tactile sensor strip at the actuating means.

9. The anti-trap device of claim 1, wherein the detection device is embodied as a sensor which can be attached to a mating contact section, which is assigned to the body part, of the vehicle body.

10. The anti-trap device of claim 1, wherein the vehicle has an automatically actuable body part with a drive mechanism, and wherein when a relative movement between the actuating means and the body part is detected, the drive mechanism of the body part can be deactivated.

11. The anti-trap device of claim 1, wherein the actuating means has a main body made of plastic material.

12. The anti-trap device of claim 1, wherein the vehicle has a manually actuable body part and is configured to emit a warning signal, and wherein when a relative movement between the actuating means and the body part is detected, the vehicle emits the warning signal.

13. An anti-trap device on a vehicle for preventing trapping of an object between two parts on the vehicle, comprising:

an actuating means which can be coupled to a body part of the vehicle and, as a result of contact against the object, is movable relative to the body part, the actuating means having a slot;

a detection device for detecting a relative movement between the actuating means and the body part; and a fastening strip which can be fixedly attached to the body part of the vehicle, the fastening strip having a rotary axle defining a direction of pivoting movement, the actuating means being articulatedly connected to the rotary axle to pivot about the rotary axle, and the fastening strip having a guide means, which is spaced apart from the rotary axle, for the mounting and pivoting guidance of the actuating means, wherein the guide means comprises a guide bolt mounted on the fastening strip and which engages into the slot, the slot being aligned in the direction of the pivoting movement.

* * * * *